United States Patent [19]

Gunderman et al.

[11] 4,328,901

[45] May 11, 1982

[54] MULTILAYER PRESSURE VENT FOR EXPLOSION PROOF ENCLOSURES

[75] Inventors: Robert J. Gunderman, Columbus; Michael W. Riley, Strongsville, both of Ohio

[73] Assignee: The United States of America as represented by the Secretary of the Interior, Washington, D.C.

[21] Appl. No.: 213,446

[22] Filed: Dec. 5, 1980

[51] Int. Cl.[3] ..... B65D 25/00

[52] U.S. Cl. ..... 220/88 A; 220/88 R; 220/371

[58] Field of Search ..... 220/88 A, 88 R, 231, 220/334, 337, 371

[56] References Cited

U.S. PATENT DOCUMENTS 2,801,768 8/1957 Immel ..... 220/88 A 4,180,177 12/1979 Gunderman et al. ..... 220/88 A

*Primary Examiner*—George T. Hall

*Attorney, Agent, or Firm*—Thomas Zack; Donald A. Gardiner

[57] ABSTRACT

A pressure vent for an explosion proof container. The vent allows a high flow rate of gases to pass from the container while arresting flames and cooling exiting hot gases therein. This precludes the build-up of high peak pressures inside the container. Structurally the vent has a protective cover mounted to the container by a knife hinge on one side and closed by imbedded magnets on the opposite side. In addition, the vent has multilayered material mounted in the same container opening near the interior of the container. A layer of porous stainless steel foam with multiple layers of stainless steel screen is used for this vital multilayered material. The optimum embodiment is obtained by preselecting a relationship between the free space volume inside the enclosed container, the number of layers in the prefilter section of the vent, and the cross sectional area of the vent.

9 Claims, 3 Drawing Figures

MULTILAYER PRESSURE VENT FOR EXPLOSION PROOF ENCLOSURES

BACKGROUND OF THE INVENTION

1. Field of the Invention

Our invention is a specially constructed vent used with explosion proof containers.

2. Description of the Prior Art

Pressure vents of various types are known in the patent art, especially in current Class 220, subclass 88, of the United States Patent and Trademark Office classification system entitled "Metallic Receptacles, Fire Preventing." However, none of this or any other known art can accomplish the results obtained by this invention using the same or similar structure.

The commonly assigned U.S. Pat. No. 4,180,177 to R. J. Gunderman et al was invented by us in conjunction with two other inventors. It discloses a protective outer cover similar to the type we employ with the multilayered material disclosed herein. Its contents is specifically incorporated by reference herein. In considering our present invention, it is vitally important to consider its use and how it interrelates the environment in which used. Essentially it relates to a vent for a protective container which will allow a high flow rate of gases to pass from the container to the outside environment while, at the same time, arresting the flame and cooling its gases before release from the container. The importance of this type of invention becomes self-evident if the container protects electrical controls for mining machines, etc., such as within a coal mine where the air may be laden with an explosive mixture of methane gas.

The patent art discloses many different single layered and several multilayered vent materials. In the mentioned R. J. Gunderman et al patent, the single layered plate 29 forming the porous flame arresting and gas cooling material is made of a porous stainless steel foam material sold under the trade name RETIMET. The same stainless steel foam material is used in the present invention combined with multiple layers of stainless steel screen to achieve the desired results. The known multilayered vent materials use different materials either because they are breathers, and not pressure vents, which allow equalization of pressure on both sides at a slow rate of gas flow or because they are much less effective in providing the results we obtain if at all. For example, U.S. Pat. No. 1,731,406 (F. Bernard) is a safety vent for oil tanks and acts as a breather made up of a flame resistant sponge-like material 10 layered with a fine screen 11. As such, it would not be able to allow the high gas flow rate we do nor would it be able to withstand repeated explosions inside the container. Although similar in its stated desired results, U.S. Pat. No. 2,801,768 (R. B. Immel) does not employ a multilayered vent. It uses for its vent a porous metal filter plate having multitudinous, tortuous, interconnecting pores formed between sintered particles covering the opening. This material would not, according to our testing, provide the gas flow rate needed with the same size vent. Further, the sintered material would have to be protected from damage and clogging.

Other U.S. Pat. Nos. (2,743,035, Fogarty; 3,394,843, Grady, Jr. et al, and 4,149,649, Szego), are also known. None employ the stainless steel foam material we employ in combination with layers of stainless steel screen to achieve the same or similar results we obtained.

SUMMARY OF THE INVENTION

The pressure vent constituting the subject matter of this invention is made up of several interrelated elements. An explosion proof housing or container has an opening in which the pressure vent assembly is mounted. This assembly consists of a protective cover which serves as an access door mounted to the housing by a knife edge hinge on one side and imbedded magnets on the opposite side. The assembly also has located in the same opening, nearer the internal cavity of the housing, a multilayered flame arresting material portion which completely covers the opening. Beginning from the outside to the inside, the material consists of a porous stainless steel foam layer and multiple layers of stainless steel wire mesh screens. Should the gas pressure on the inside of the housing exceed the outside gas pressure by as little as one pound per square inch (psi.), then the protective cover door is opened.

The primary object of this invention is an improved pressure responsive vent assembly for use with an explosion proof housing.

As indicated in the commonly assigned U.S. Pat. No. 4,180,177, explosion-proof enclosures for use in gassy mines or tunnels are required to meet certain specific requirements. When these enclosures house electrical equipment for use with mining machines, etc., such as is used in coal mines, the enclosures must not only resist the internal pressure of a possible explosion and contain any resulting flame therein, they also reduce or release gas pressure in a nonhazardous manner. Generally this vent acts to relieve the gas pressure build-up as soon as possible so as not to endanger the housing while, at the same time, confining the flames to the housing and cooling its liberated gases before they leave the housing. In the embodiment of our invention to be described with respect to FIGS. 1–2, a pressure drop of one psi. was sufficient to open the protective outer door to allow the internal gas to rapidly flow therefrom while the flames are contained therein and the size of the vent opening kept to a minimum cross-sectional area. The particular unique construction of the pressure vent assembly allows the enclosure to withstand repeated internal explosions without damaging the enclosure's housing and also prevents flames from igniting any ambient methane/air mixture in the mine.

Figure 1:
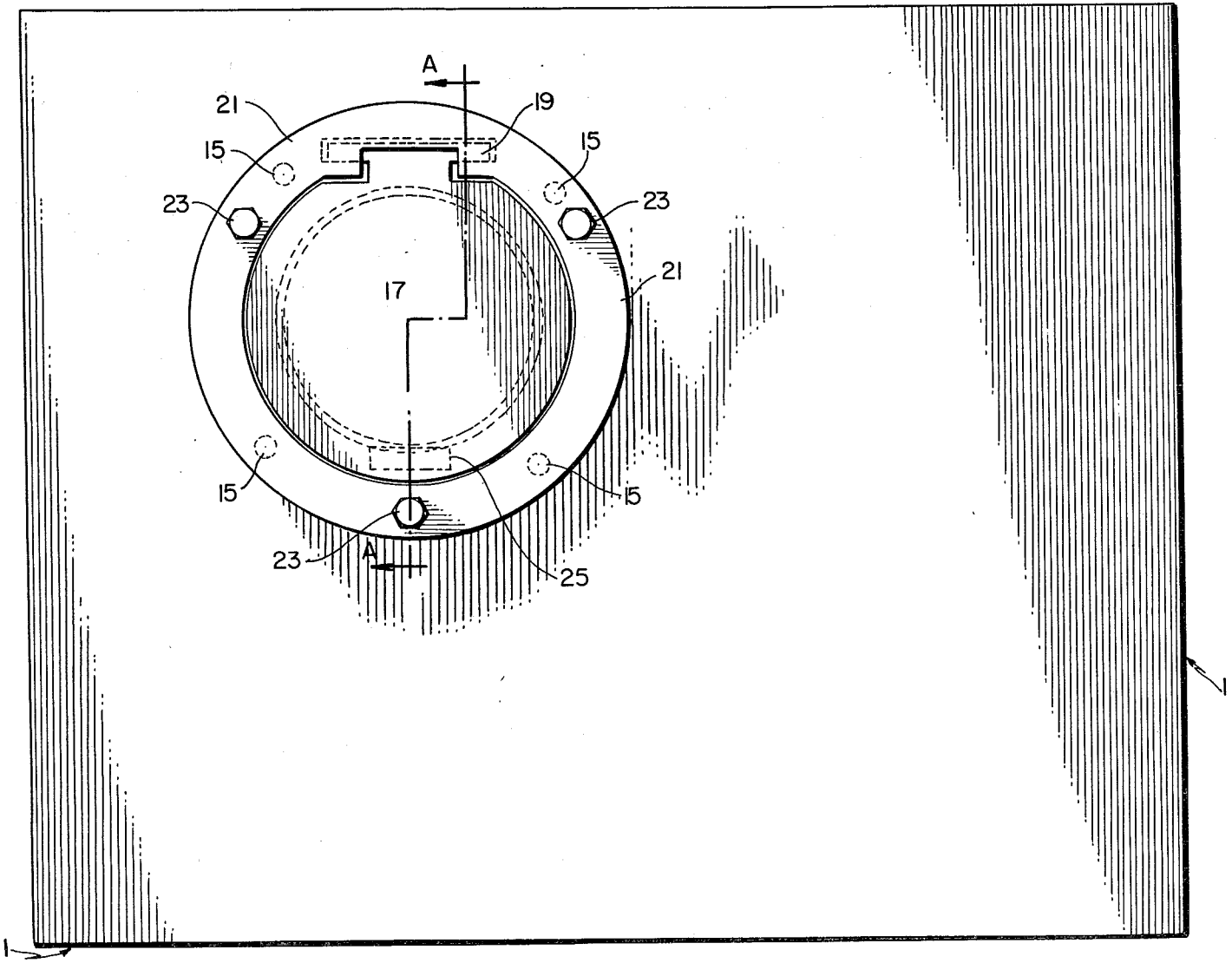
FIG. 1 is a front view of the explosion proof housing and the preferred embodiment of the protective covering which forms part of the pressure vent assembly.

FIG. 1 depicts an explosion proof enclosure or housing 1 which may assume any shape needed to protect the outside volume from an explosion occurring therein. As shown, this housing is a rectangular boxed shape enclosure which can, for example, enclose electrical controls useable on a mining machine. Clearly, the type of circuitry enclosed, or whether it is any electrical circuit which is to be enclosed, is of no consequence as long as the housing is sufficiently strong to prevent an internal explosion from damaging it. Welded to the housing, which may be located on any side of the bay or on the removable cover, is a boss 3 such that it encircles the opening 5 to internal cavity 7 of the housing. Starting from this cavity (FIG. 2) and looking to the left there are shown multiple layers of stainless steel wire mesh screens 9 and the metal foam flame arresting material layer 11. The retaining flange 13 has an inside opening somewhat smaller in diameter than the multilayer material such that it overlaps a small area of the multilayer material around the periphery. The retaining flange 13 is secured to boss 3 by bolts 15 into blind tapped holes thus assuring that the multilayer material is trapped within the boss against the interior wall of the housing. The multilayered foam and screen materials have a slightly greater thickness than that of the boss and a greater surface area than that of the opening into which fitted. By compressing these multilayered materials around their edges with the retaining flange, a tight fit between the housing and flange is assured. If required, the layers of mesh screens and the porous metal foam may be permanently bonded together to assure that everything is properly in place when inspected from the outside.

Figure 2:
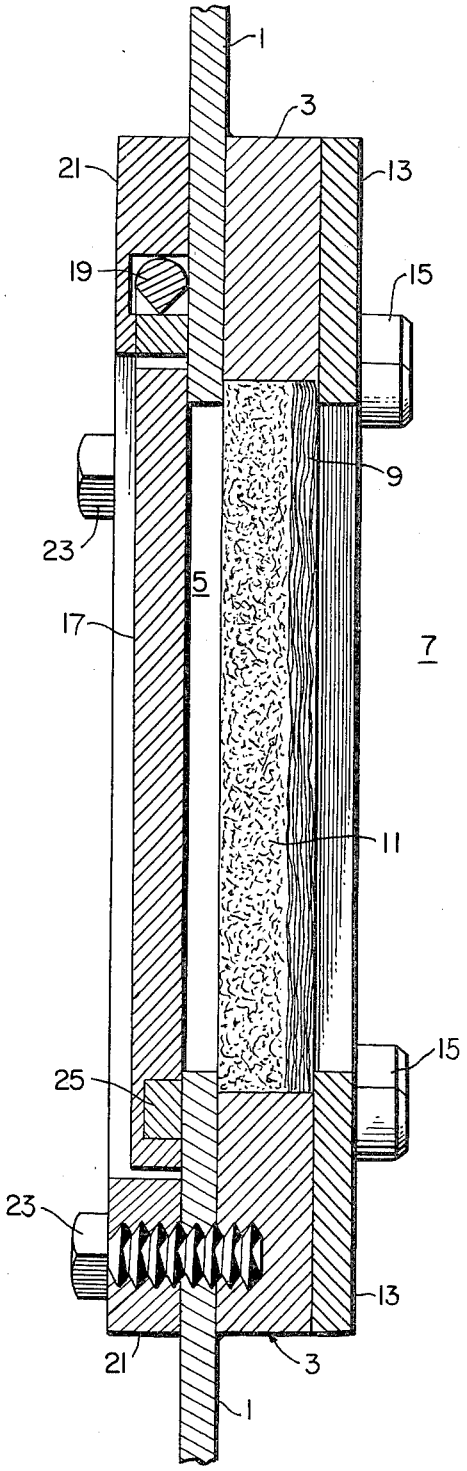
FIG. 2 is a cross-sectional view along line A—A of FIG. 1 and shows the preferred embodiment of the complete pressure vent assembly.
Figure 3:
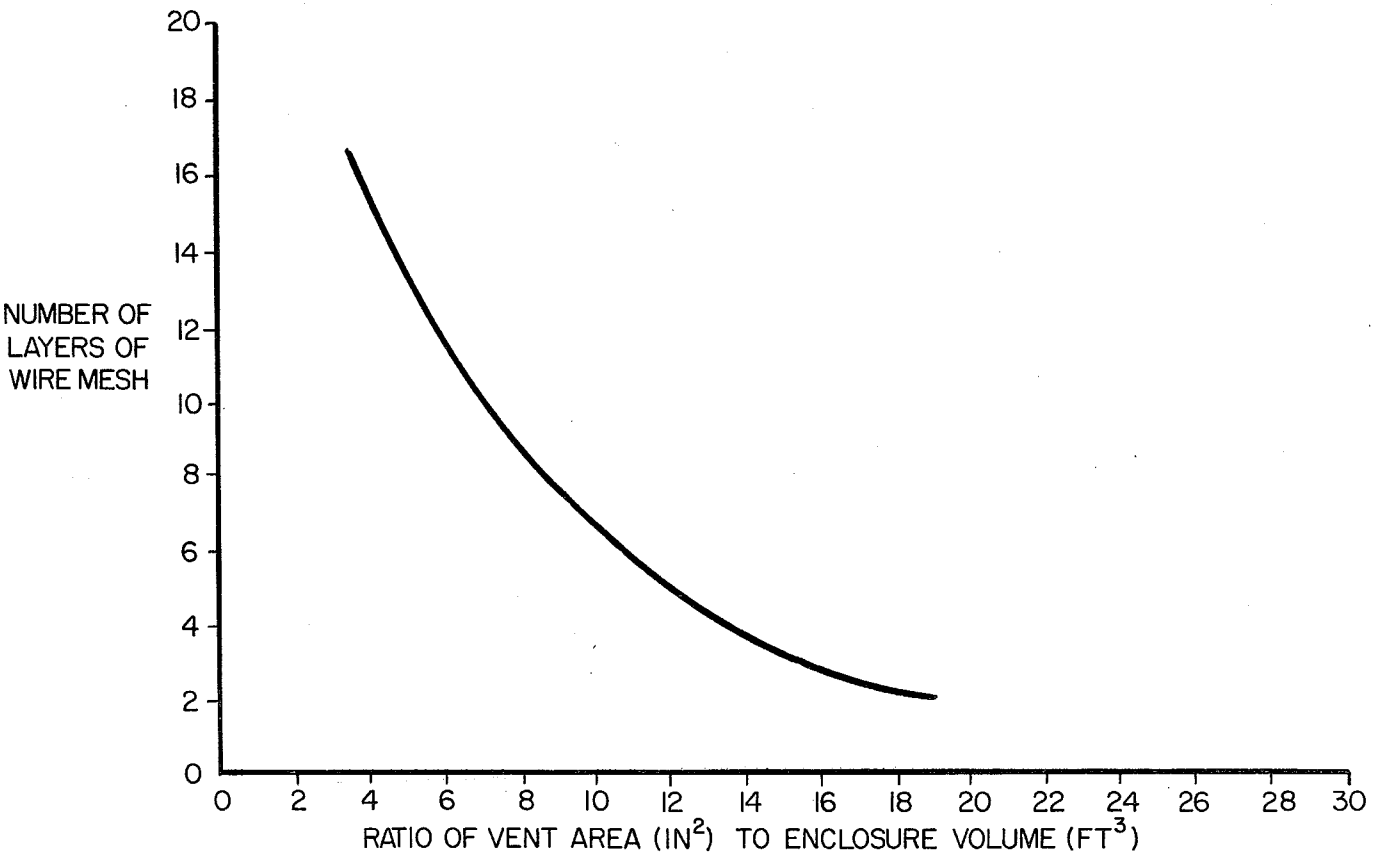
FIG. 3 is a graph showing the typical requirements for the number of layers of wire mesh as a function of the ratio of vent surface cross section to the enclosure volume.

The cross-sectional area of the opening 5, as shown in FIG. 2, is a function of the volume 7 inside the housing, the number of layers and the characteristics of the wire mesh screens 9, and the allowable maximum internal gas pressure rise. The relationships shown in FIG. 3 were determined through many experimental tests. A peak internal pressure of less than 12 psi was selected as the criteria for improvement over a specified value of 126 psi in Government regulations for conventional (non-vented) explosion-proof electrical enclosures in underground coal mines. Test showed that the inside surface of the metallic foam can be kept below 1800° F. so as not to be damaged when at least three layers of metallic mesh screens are used as a prefilter, or by keeping the ratio of cross-sectional area of metallic foam to the enclosure internal volume equal to or greater than 28. The size wire and the mesh size in the metallic mesh was found to be noncritical within a range of values. A 20 mesh, 0.018 inch diameter type 304 stainless steel wire was selected as being convenient for packaging in this application. Adjacent layers of wire mesh are offset by one half the wire spacing and rotated by 45 degrees. The most sensitive criteria determining the relationships in FIG. 3 is the maximum temperature on the outside of the vent surface which must be kept below 302° F. to avoid ignition of coal dust.

Protective cover 17 is, in the preferred embodiment, a steel plate hung by the hinge knife edge 19 at its top. Retainer cover 21 encircles the protective cover and provides a surface against which the knife edge rests and also retains the same while providing mechanical protection for the protective cover. The three external bolts 23 secure the retainer cover to the housing and boss (see FIG. 2). Normally the protective cover hangs closed, as shown in the two figures, due to the force of gravity. A small magnet 25 is embedded in the lower inside section of the protective cover opposite the hinge to keep the cover from flapping. When the gas pressure inside the enclosure exceeds the outside gas pressure by approximately 1 psi., the protective cover is pushed open (to the left in FIG. 2) by the flow of the gas/air.

Since the purpose of this invention is to arrest flames and cool hot gases coming from inside the container while, at the same time, allowing a high flow rate therefrom, all fits are such that no paths exist for the flames or burning particles to escape from inside the container. However, mixtures of ambient low pressure air/methane gas from the coal mines are not prevented from entering or leaving by the fit thus allowing the unit to also perform as a breather as well as a pressure vent. The peak high pressure build-up within the container is maintained at a low level, e.g., it is less than 12 psi. as compared to gas pressures up to as high as 150 psi. Although the pressure vent invention in the commonly assigned U.S. Pat. No. 4,180,177 can also meet this 12 psi. criteria, the present invention has the ability thereover of being able to withstand repeated explosions inside the enclosure of methane/air mixtures with a substantially smaller cross-sectional vent opening. For example, a 28 square inch area vent with 10 layers of wire mesh is adequate for a 4 cubic foot enclosure whereas 112 square inches of vent area is required in the previous invention. These two features make its application very practical for use on underground coal mining machinery.

The combination of materials selected for the foam and screens—stainless steel foam with multiple layers of stainless steel screens—is the only known combination which can meet the performance and other requirements mentioned. In addition, this combination also is self-cleaning in the event of an explosion inside the container. Others may exist, however, our exhaustive tests failed to disclose them.

Advantages of this multilayer assembly include:

Smaller surface cross-section multilayer vents provide the equivalent protection of larger porous metal foam vents alone.

Thermal capacity of the inside surface is greater with the stainless steel wire mesh screens thereby increasing vent durability.

Hot gases are precooled by the stainless wire mesh before they impinge on the less rugged metal foam.

The combined materials result in a more rugged and durable structure.

The porous metal foam provides a finer and more effective filter than with mesh screens alone, thereby minimizing assembly thickness.

The porous metal foam provides increased heat exchange surface to material volume, thereby optimizing the thermal efficiency of the assembly.

It is very apparent that many changes can be made to the geometric shape and designs of the pressure vent disclosed in the preferred embodiment. None of these changes should be used to limit the scope and extent of the invention which is to be measured only by the claims that follow.

We claim:

1. A pressure vent device comprising:

a housing adapted to enclose said electrical apparatus;

a vent opening extending from the interior to the exterior of the housing;

flame arrestor means affixed in the opening for preventing flames from propagating through the opening in the event of an explosion of gas to vent through the opening at a predetermined pressure, said flame arrestor means including a multilayered material consisting of a metallic foam material adjacent to a plurality of metallic mesh screens;

the enclosure including a seat surrounding the opening on the exterior side of the flame arrestor means;

a cover sized and shaped to close the opening and fit against the seat for protecting the flame arrestor means;

hinge means for connecting one edge portion of the cover to the enclosure while permitting an opposite edge portion to swing away from the seat;

releasable latch means for holding said opposite edge portion against the seat until a predetermined pressure is reached in the enclosure; and closing means for automatically returning said opposite edge portion into contact with the seat after the enclosure pressure drops below said predetermined pressure.

2. The device of claim 1, wherein the metallic foam material is made from stainless steel foam and said mesh screens are made from stainless steel screens.

3. The device of claim 1, wherein the mesh screens are mounted in the opening so as to be closer to the interior of the enclosure than the metallic foam.

4. The device of claim 1, wherein the foam material and mesh screens are bonded together.

5. The device of claim 1, and further including a vent body connected to a forming part of the enclosure, the opening extending through the body.

6. The device of claim 5, wherein the hinge means includes:

load bearing elements connected to the top of the cover; and flat bearing surfaces formed in the vent body, whereby the cover is suspended from the load bearing elements.

7. The device of claim 5, wherein the load bearing elements comprise knife-edged members.

8. The device of claim 1, wherein the latch means includes a magnet disposed in said opposite edge portion of the cover, and a cooperating portion of the enclosure is formed of a magnetically susceptible metal.

9. The device of claim 1, wherein said closing means includes the cover being vertically disposed when said opposite edge engages the seat and the cover having sufficient weight so that it will close by gravity after said pressure drop.

* * * * *